United States Patent [19]

Roth et al.

[11] Patent Number: 4,462,504

[45] Date of Patent: Jul. 31, 1984

[54] TAMPER-INDICATING CLOSURE

[75] Inventors: Donald J. Roth, Westport; Charles S. Kubis, Weston, both of Conn.; John Walter, Evergreen Park, Ill.

[73] Assignee: Continental Packaging Company, Inc., Stamford, Conn.

[21] Appl. No.: 497,308

[22] Filed: May 23, 1983

[51] Int. Cl.[3] ..... B65D 55/02

[52] U.S. Cl. ..... 220/214; 220/307; 220/339; 215/237; 215/321; 215/235; 222/153; 222/543

[58] Field of Search ..... 220/306, 307, 339, 270, 220/269, 242, 271, 272, 315; 215/235, 237, 245, 240, 242, 224, 225, 317, 321, 272; 222/153, 543, 545

[56] References Cited

U.S. PATENT DOCUMENTS

| | | | |
|---|---|---|---|
| 2,887,117 | 5/1959 | Rosholt | 220/306 X |
| 3,081,011 | 3/1963 | Stull | 222/153 |
| 3,381,916 | 5/1968 | Edgell | 220/339 X |
| 4,344,545 | 8/1982 | Aschberger et al. | 220/307 |
| 4,386,714 | 6/1983 | Roberto et al. | 220/339 |
| 4,397,400 | 8/1983 | Walter | 220/307 X |
| 4,407,423 | 10/1983 | Walter | 220/307 X |

*Primary Examiner*—William Price
*Assistant Examiner*—Bryon Gehman
*Attorney, Agent, or Firm*—Charles E. Brown

[57] ABSTRACT

This relates to closure assemblies for containers which are subject to tampering. This particularly relates to closure assemblies of the type which include a lever type actuator wherein the lever must be lifted to apply leverage to a closure plug portion to facilitate opening of the closure assembly. Such levers are customarily retained in place by rivets which include frangible portions. This particularly relates to the configuration of such rivets and the details of the lever wherein, once the lever has been pried from its original position and disengaged from the rivet, the lever or an end portion only thereof tilts upwardly due to the non-returnability of the rivet through its original opening thereby to present a visual indication of tampering which can be readily ascertained.

9 Claims, 10 Drawing Figures

TAMPER-INDICATING CLOSURE

This relates to a combination dispensing spout and closure therefor which is formed of a plastic material and which could be subject to tampering. This invention particularly relates to an anti-tampering feature wherein, once an operating lever thereof is initially lifted, it cannot be returned and thus remains elevated to indicate tampering.

With the above and other objects in view that will hereinafter appear, the nature of the invention will be more clearly understood by reference to the following detailed description, the appended claims, and the several views illustrated in the accompanying drawings.

Figure 1:
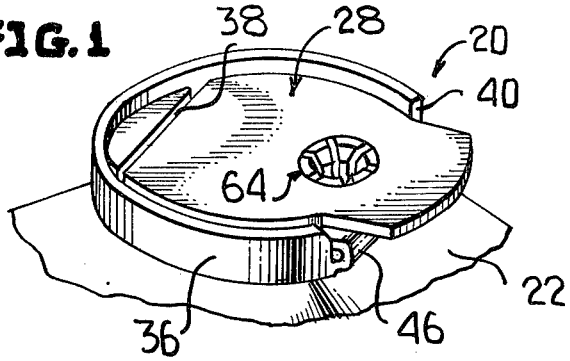
FIG. 1 is a top perspective view of one form of closure formed in accordance with this invention, and shows the same in its closed position.

Referring now to the drawings in detail, it will be seen that FIG. 1 illustrates a closure assembly generally identified by the numeral 20 which is mounted on a dome-like portion 22 of a container. The closure assembly 20 is of a conventional construction, and the improvement in the closure assembly 20 resides in a tamper indicating feature which will be specifically described hereinafter.

Figure 3:
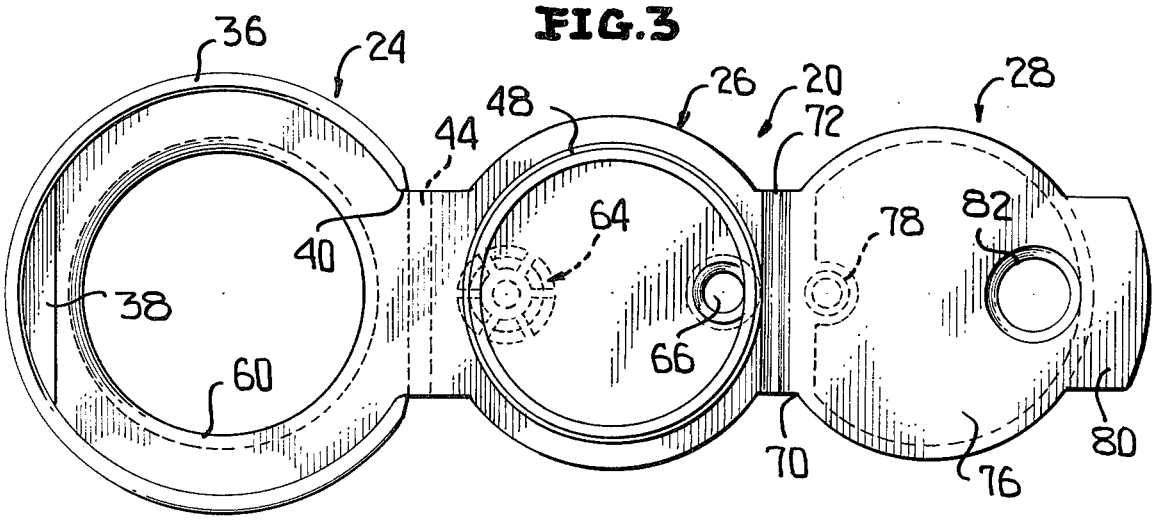
FIG. 3 is a plan view of the closure member in its as molded state.
Figure 4:
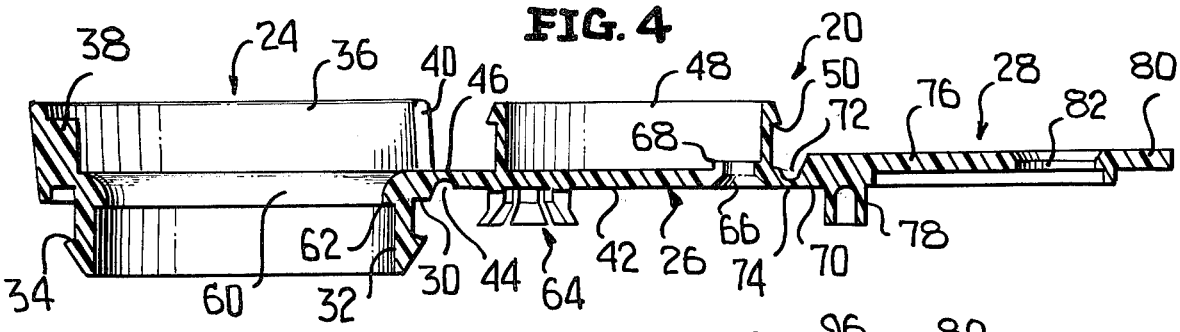
FIG. 4 is a longitudinal vertical sectional view taken through the closure of FIG. 3.

The closure 20, as is best shown in FIGS. 3 and 4, is of a three-part integrally formed assembly including a base member 24, a closure plug member 26, and a lever member 28.

The illustrated base member 24 includes a central ring portion 30 having depending therefrom a plug 32 which is tubular and which is intended to be telescoped within a neck opening of a container such as the dome-like member 22. To this end, the plug 32 is provided with an upwardly facing outer annular shoulder 34 for locking engagement with the container member.

The base member 24 also includes an upstanding guard collar 36 having in diametrically opposite relation a fulcrum shoulder 38 and an opening 40.

The plug member 26 has a centrally located closure panel 42 which, when molded, is planar with the ring portion 30 and is connected thereto along a weakening line 44 which defines a hinge 46. The plug portion 26 has, in its as molded state, a cylindrical plug element 48 which extends axially upwardly from the closure panel 42. The plug element 48 is provided with a radially outer locking shoulder 50.

At this time it is pointed out that the ring member 30 has a central opening 60 therethrough of a reduced diameter, thereby defining a downwardly facing locking shoulder 62. The opening 60, in the open condition of the closure assembly 20, defines a pour opening.

The plug element 48 is of a diameter to be forced through the opening 60 and, when properly positioned, will its locking shoulder 50 engaged beneath and behind the shoulder 62.

The closure panel 42 has projecting downwardly therefrom adjacent the hinge 46 a tamper indicating, lever retaining rivet 64 which is the subject of this invention and which will be described in more detail hereinafter.

Diametrically opposite to the rivet 64 and within the confines of the plug element 48, the closure panel 42 is provided with a vent opening 66 which extends therethrough and which is in part defined by an upwardly projecting portion 68.

The lever portion 28 is connected to the closure panel 42 by a strap 70 which lies in the plane of the closure panel 42. The strap 70 has formed therein a weakening line 72 which, in turn, defines a hinge 74.

The lever portion 28 includes a primary panel member 76 which has depending therefrom a vent plug 78 which is receivable within the vent opening 66 to close the same. The lever panel 76 is provided with an extension 80 which, in the assembled state of the closure assembly 20, extends through the opening 40 as shown in FIG. 1.

The lever panel 76 is also provided with an opening 82 therethrough. The opening 82 is diametrically opposite the vent plug 78 and is of a size and location to receive the rivet 64.

The closure unit, as described above, is the subject of other applications filed by us, and the structure thereof per se is not the subject of this invention. Further, the specific manner in which the base member 24 is assembled with the container is in no way material with respect to this invention and, in fact, the plug portion 32 thereof could be omitted and the plug element 48 could be directly interlocked with a portion of the container.

Figure 2:
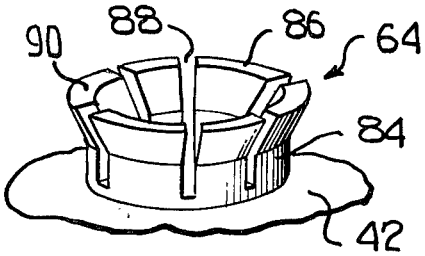
FIG. 2 is an enlarged fragmentary perspective view showing the formation of a lever retaining rivet which is the principal feature of the invention.

As stated above, this invention relates to the tamper-indicating feature of the invention. The rivet 64, which in the past has been upset after the assembly of the plug portion and the lever portion, in accordance with this invention, as is best shown in FIG. 2, includes a cylindrical base 84 which is integral with the closure panel 42. The cylindrical base has extending upwardly therefrom a radially outwardly flared securing portion 86. Further, and most particularly, both the base 84 and the securing portion 86 are provided with a plurality of radially extending, circumferentially spaced, axial slots 88 to define a plurality of circumferentially separated rivet segments 90.

Figure 5:
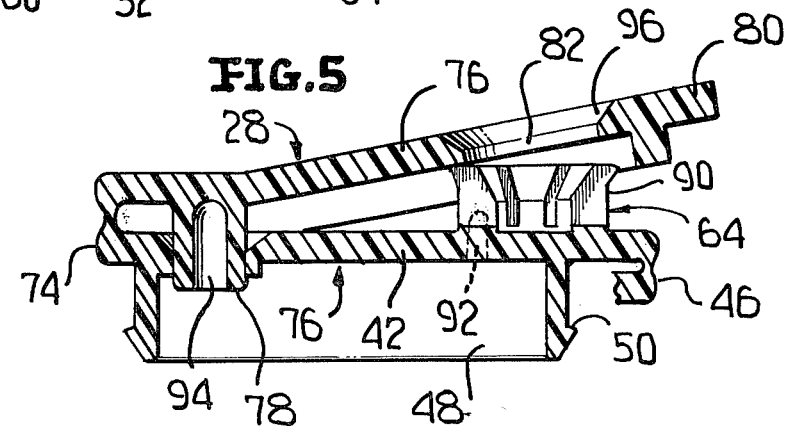
FIG. 5 is a sectional view, with parts broken away, through the center of the assembled closure with the lever thereof in an initially lifted, nonreturnable position.

As is clearly shown in FIG. 5, the rivet 64 is of a size wherein it will not, under normal conditions, pass through the opening 82 in the lever panel 76. However, when the closure assembly 20 is initially assembled, a special fixture will collapse the locking portion 86 to a cylindrical configuration of a size to pass through the opening 82.

At this time it is pointed out that one of the segments 90 has extending upwardly thereinto a blind passage 92 which opens through the closure panel 42. It is also pointed out here that the vent plug 78 is provided with a blind passage 94.

It is to be understood that the closure assembly 20 is primarily intended to be used in the packaging of soft drinks and like beverages which are packaged under internal pressures although the use of the closure assembly is not so limited. It is to be understood that if one attempts to tamper with the contents of the associated container, one may try to use a sharp instrument to sever either the rivet 64 or the vent plug 78. Because of the blind passages 92, 94, if either is severed the gaseous pressure within the associated container will immediately be vented to the atmosphere together with certain of the product, both to give a visual and an audible indication of tampering. It is also to be understood that if the product is non-pressure packed, any tipping of the container would also result in discharge of the product to indicate tampering.

Most particularly, it will be seen that when the lever portion 28 is lifted, a tapered outer part 96 of the opening 82 will cause a radial inward deformation of the lever locking portion 86 and permit the rivet to be withdrawn through the lever panel 76. This partially opened state is shown in FIG. 5. Once this initial opening movement of the lever portion 28 has been effected, the rivet 64 again re-expands and without special tooling cannot be collapsed such that the lever portion 28 will return to its initial position. Thus, the lever portion 28 will continuously be tilted upwardly as shown in FIG. 5, thereby giving it a readily ascertainable visual indication of tampering.

Figure 6:
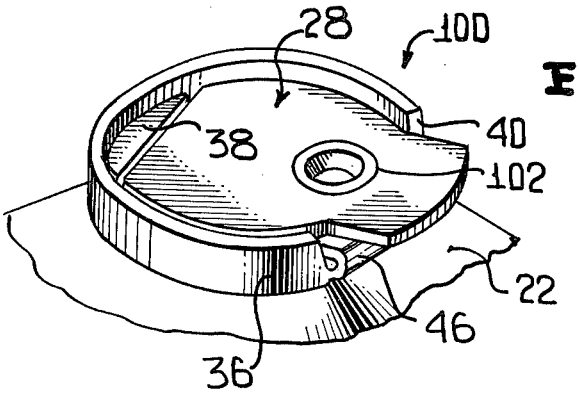
FIG. 6 is a top perspective view of a modified form of closure assembly.
Figure 7:
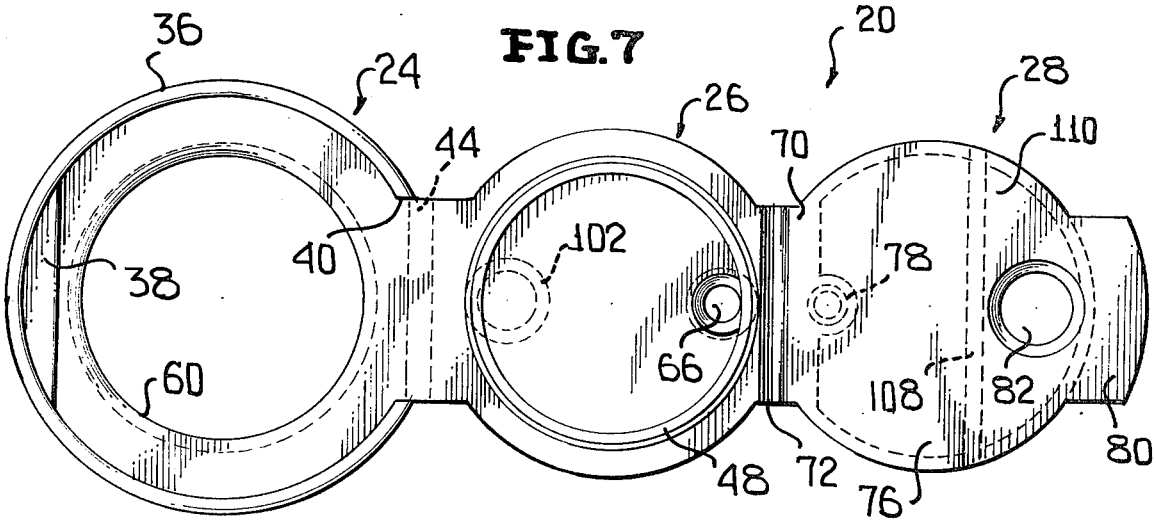
FIG. 7 is a plan view of the closure assembly of FIG. 6 in its as molded condition.

Reference is now made to FIG. 6 wherein there is illustrated a slightly modified form of closure assembly generally indicated by the numeral 100. The closure assembly 100 is of the same basic construction as the closure assembly 20 and is secured to the dome-like portion 22 of a container. Inasmuch as the closure assembly 100 employs the same components as the closure assembly 20, like reference numerals will be applied to like parts and only the differences will be specifically identified here.

Figure 9:
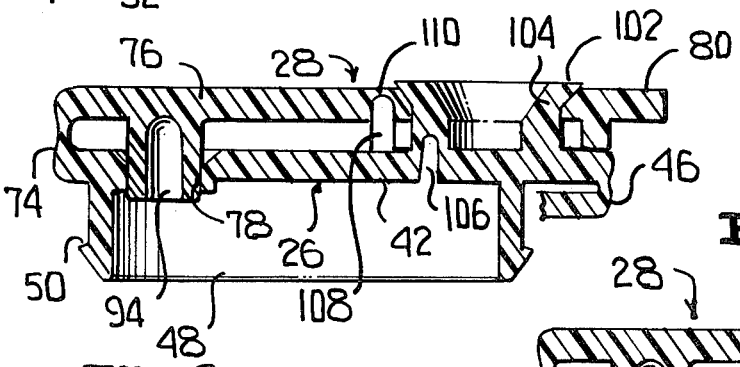
FIG. 9 is a sectional view through the closure assembly, with parts broken away and shown in section, in its assembled, closed state.

In accordance with this invention, the closure panel 42 is provided with a hollow cylindrical rivet 102 of a size to be received through the opening 82. As is best shown in FIG. 9, after the lever portion 28 has been assembled with the plug portion 26, as shown in FIG. 9, the axially outer part of the rivet 102 is radially outwardly flared to define a locking portion 104. At this time it is pointed out that the rivet 102 and the closure panel 42 have opening down therethrough a blind passage 106 such that should the rivet 102 be severed for the purpose of opening the container without giving an indication of tampering, the blind vent passage 106 will become open to the atmosphere in the manner described with respect to the vent passage 92.

Figure 8:
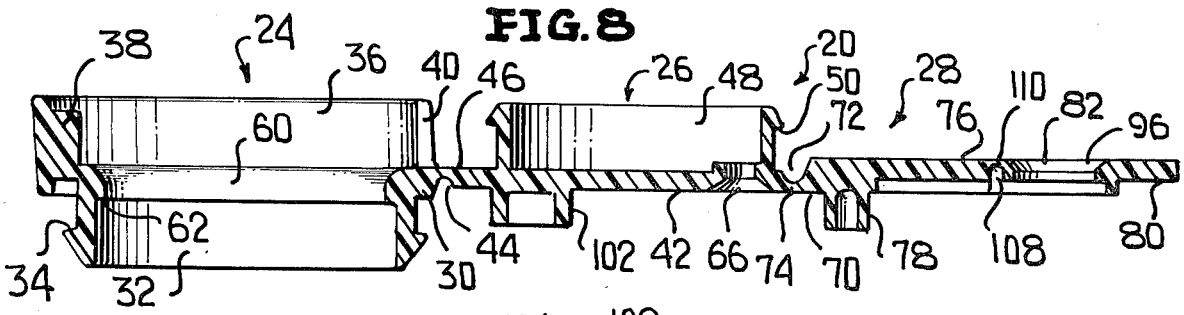
FIG. 8 is a longitudinal vertical sectional view taken through the closure assembly of FIG. 7.

A principal feature of this form of the invention is that there is formed in the underside of the lever panel 76 adjacent the opening 82 a transversely extending weakening line 108 which is best shown in FIG. 8. This weakening line 108 defines a stretchable hinge 110.

Figure 10:
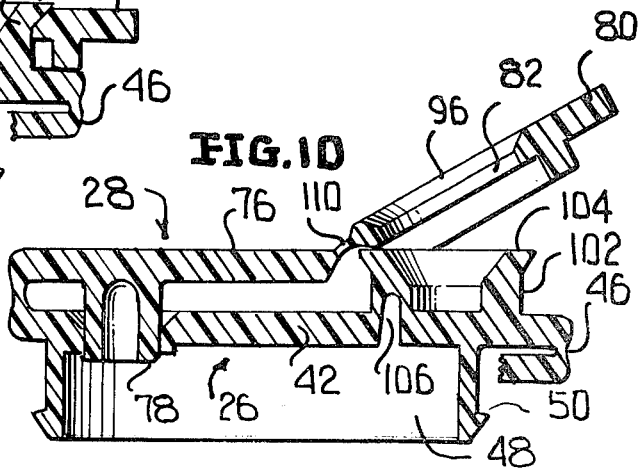
FIG. 10 is a sectional view similar to FIG. 9, and shows the actuating lever in an initially lifted, nonreturnable state.

When the container of which the closure assembly 100 is a part is to be opened, and an upward pressure is directed against the lever extension 80, when sufficient force is applied, due to the tapered configuration of the outer portion 96 of the opening 82, the locking portion 104 of the formed rivet is compressed radially inwardly so as to effect its passage through the opening 82 to release the lever portion 28. As the lever portion 28 is continued to be lifted, hinging thereof will occur along the hinge line 110 and, due to the relative thinness of the lever panel 76 along the hinge line 110 and the required force, the material defining the hinge line 110 will stretch transversely of the hinge line so as to effect a positive displacement of the opening 82 to the right, as viewed in FIG. 10, relative to the rivet 102, thereby preventing realignment of the opening 82 with the rivet 102 to facilitate the return passage of the rivet through the opening. Thus, no matter how hard one attempts to return the lever portion 28 to its original position of FIG. 9, one cannot do so and the end part of the lever portion 28 will tilt upwardly as shown in FIG. 10, thereby indicating a prior tampering.

Although only two preferred embodiments of closure assemblies have been specifically identified, it is to be understood that minor variations may be made in the closure assemblies without departing from the spirit and scope of the invention as defined by the appended claims.

We claim:

1. In a closure of the type which includes a closure member for effecting a seal, a vent opening through said closure member, a lever member connected to said closure member along a hinge line for moving the same to an open position, and said lever member carrying a plug receivable in said vent opening to close the same; a tamper indicating means including a rivet carried by said closure member and said lever member having an opening therethrough receiving said rivet, said rivet being hollow and having a radially outwardly flared resilient end portion which is radially inwardly deformable to release said lever member.

2. In a closure, tamper indicating means as defined in claim 1 wherein said opening in said lever member has an outer part in the form of a tapered seat receiving said rivet flared end portion being seated on said tapered seat, and the hollowness of said rivet and the taper of both said seat and said rivet end portion combining to collapse said rivet and to release said lever member upon the application of a lifting force to said lever member.

3. In a closure, tamper indicating means as defined in claim 2 wherein said rivet is divided into a plurality of separate circumferentially spaced segments separated by radial slots to facilitate temporary radial collapsing of said rivet.

4. In a closure, tamper indicating means as defined in claim 3 wherein at least one of said rivet segments is hollow and opens through an underside of said closure member whereby should said unit be cut to release said lever member a venting would occur.

5. In a closure, tamper indicating means as defined in claim 2 wherein said rivet is circumferentially continuous.

6. In a closure, tamper indicating means as defined in claim 2 wherein said rivet is circumferentially continuous and is initially cylindrical.

7. In a closure, tamper indicating means as defined in claim 2 wherein said rivet is circumferentially continuous and is initially cylindrical, said flared end portion being formed by radially outwardly deforming an outermost part of said cylindrical rivet.

8. In a closure, tamper indicating means as defined in claim 1, said lever member having a transverse fold line adjacent said opening therein and on the side of said opening towards said hinge, and said lever member being stretchable transversely of said fold line during opening of the closure wherein after opening of the closure wherein after opening of the closure, said opening is displaced relative to said rivet to prevent reinsertion of said rivet through said opening.

9. In a closure, tamper indicating means as defined in claim 1 wherein said rivet is divided into a plurality of separate circumferentially spaced segments separated by radial slots to facilitate temporary radial collapsing of said rivet.

* * * * *